US008459954B2

(12) United States Patent
Anderson et al.

(10) Patent No.: US 8,459,954 B2
(45) Date of Patent: Jun. 11, 2013

(54) TORSIONAL FLEXING ENERGY ABSORBING BLADE LOCK

(75) Inventors: Carney R. Anderson, East Haddam, CT (US); Peter V. Tomeo, Middletown, CT (US)

(73) Assignee: United Technologies Corporation, Hartford, CT (US)

( * ) Notice: Subject to any disclaimer, the term of this patent is extended or adjusted under 35 U.S.C. 154(b) by 756 days.

(21) Appl. No.: 12/689,423

(22) Filed: Jan. 19, 2010

(65) Prior Publication Data

US 2011/0176925 A1 Jul. 21, 2011

(51) Int. Cl.
*F01D 5/32* (2006.01)

(52) U.S. Cl.
USPC ..... 416/221; 416/220 R; 29/889.21

(58) Field of Classification Search
USPC ..... 416/219 R, 220 R, 221, 248; 29/889.21, 29/889.22
See application file for complete search history.

(56) References Cited

U.S. PATENT DOCUMENTS

| | | | | |
|---|---|---|---|---|
| 2,753,149 | A | 7/1956 | Kurti | |
| 3,300,179 | A | 1/1967 | Gooderum | |
| 3,397,865 | A | 8/1968 | Catlow et al. | |
| 3,598,503 | A | 8/1971 | Muller | |
| 3,632,228 | A | 1/1972 | Acres | |
| 4,275,990 | A | 6/1981 | Langley et al. | |
| 4,730,983 | A | 3/1988 | Naudet et al. | |
| 5,031,858 | A | 7/1991 | Schellhase et al. | |
| 5,073,087 | A * | 12/1991 | Harrison et al. | 416/219 R |
| 5,129,786 | A | 7/1992 | Gustafson | |
| 5,151,013 | A | 9/1992 | Moore | |
| 5,481,648 | A | 1/1996 | Volponi et al. | |
| 5,522,706 | A | 6/1996 | Mannava et al. | |
| 5,868,351 | A | 2/1999 | Stamps et al. | |
| 6,845,941 | B2 | 1/2005 | Pica | |
| 6,846,159 | B2 * | 1/2005 | Zabawa et al. | 416/220 R |
| 2007/0253822 | A1 * | 11/2007 | Buisson et al. | 416/219 R |

FOREIGN PATENT DOCUMENTS

| | | |
|---|---|---|
| EP | 1355044 | 10/2003 |
| EP | 1849962 | 10/2007 |
| GB | 894704 | 4/1962 |

OTHER PUBLICATIONS

International Preliminary Report on Patentability dated Aug. 2, 2012.
International Search Report dated Apr. 18, 2011.

* cited by examiner

*Primary Examiner* — Christopher Verdier
(74) *Attorney, Agent, or Firm* — Carlson, Gaskey & Olds, P.C.

(57) ABSTRACT

A lock for constraining blades in a hub includes a flexible ring for constraining the blades from moving axially in the hub, a finger attached to the hub for preventing the ring from rotating relative to the hub and whereby the ring flexes about at least a partial circumference thereof if urged axially by the blades.

12 Claims, 3 Drawing Sheets

TORSIONAL FLEXING ENERGY ABSORBING BLADE LOCK

FIELD

This application relates to blade retention in gas turbine engines and the like.

BACKGROUND

Typically, a rotor assembly for an aircraft engine has a rotor disk and one or more arrays of rotor blades. The rotor blades extend outwardly into a working medium flow path such as air. The rotor blades engage the outer periphery or rim region of the rotor disk. The rim region of the rotor disk is defined generally by axially oriented slots that receive the roots of the rotor blades.

The working medium gases exert a tangential force and an axial force on the blades as the gases flow through the rotor assembly. The axial force on the rotor blades urges the rotor blade bases axially forward relative to the movement of aircraft carrying the engine and out of the axially oriented slots. Lock means are provided to lock the rotor blades against this forward axial movement. These locks add to the rotational mass of the rotor assembly and must be carried by the rotor disk.

If a rotor blade suffers a foreign object strike, however, the rotor blade tends to rotate about the points where the foreign object strikes sending the rotor blade's root forward relative to the movement of aircraft within the rotor disk. For this reason, to protect the integrity of the rotor and the rest of the engine, lock means are also provided to lock the rotor blades from moving axially forward.

SUMMARY OF THE INVENTION

An exemplary embodiment of a lock for constraining blades in a hub includes a flexible ring for constraining the blades from moving axially forward in the hub, a finger attached to the hub for preventing the ring from rotating relative to the hub and whereby the ring flexes about at least a partial circumference thereof if urged axially by the blades.

A further exemplary method for mounting a blade on a hub includes inserting a blade root into a slot in the hub, placing a flexible ring against the blade root, placing a finger within the ring to prevent its rotation and wherein the ring flexes axially about at least a partial circumference thereof if urged by the blade root.

These and other features of the present invention can be best understood from the following specification and drawings, the following of which is a brief description.

DETAILED DESCRIPTION OF THE PREFERRED EMBODIMENT

Figure 1:
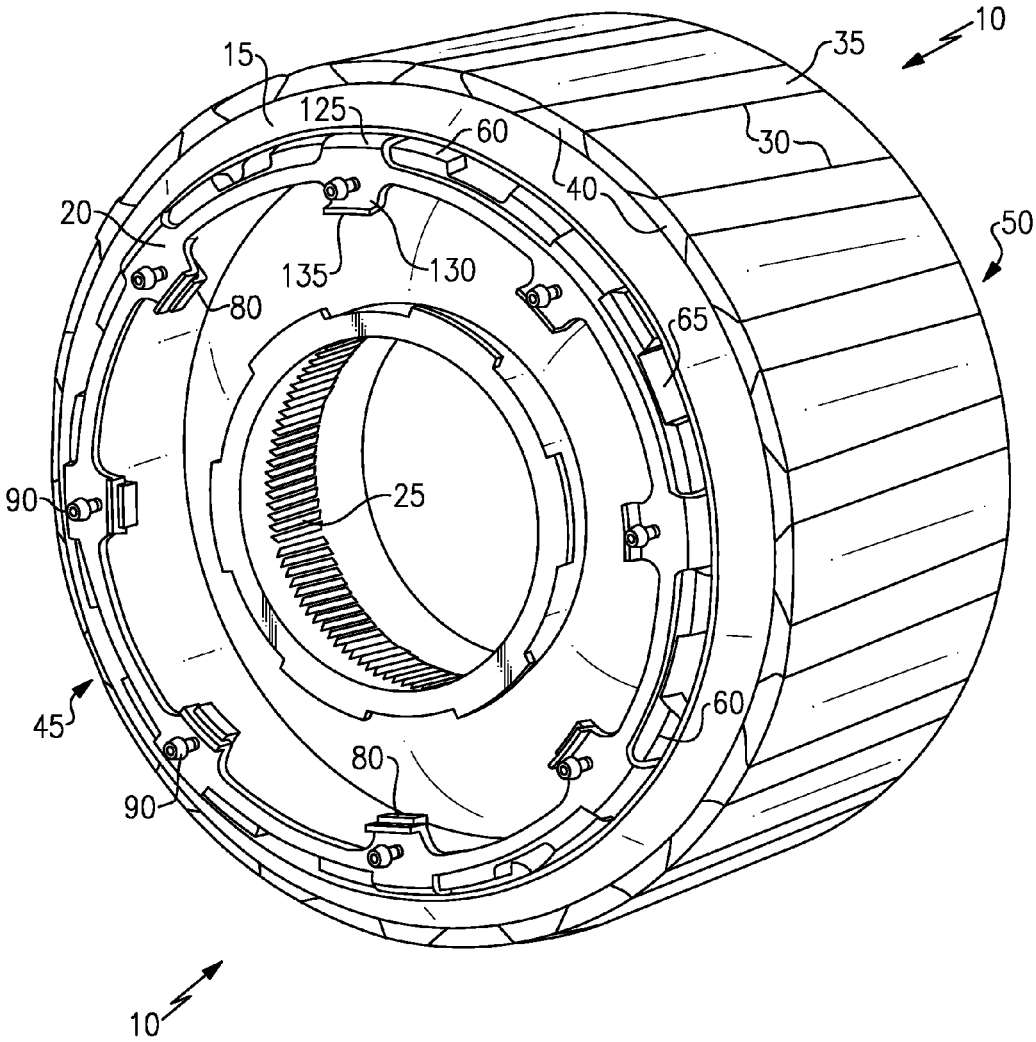
FIG. 1 is a perspective view of an aircraft hub, a lock ring and an anti-rotation ring.
Figure 2:
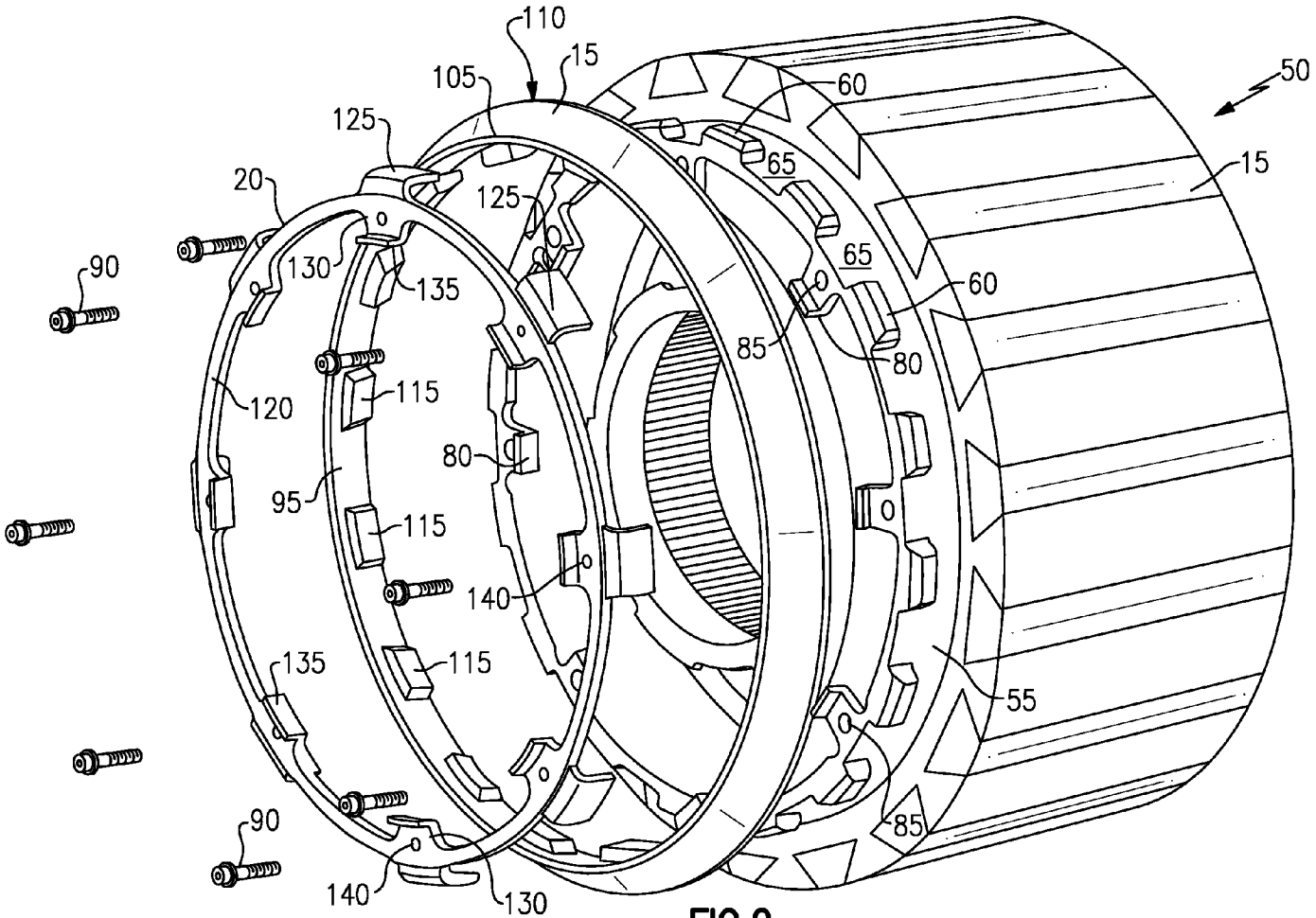
FIG. 2 is a perspective exploded view of the aircraft hub, a lock ring and an anti-rotation ring of FIG. 1.
Figure 3:
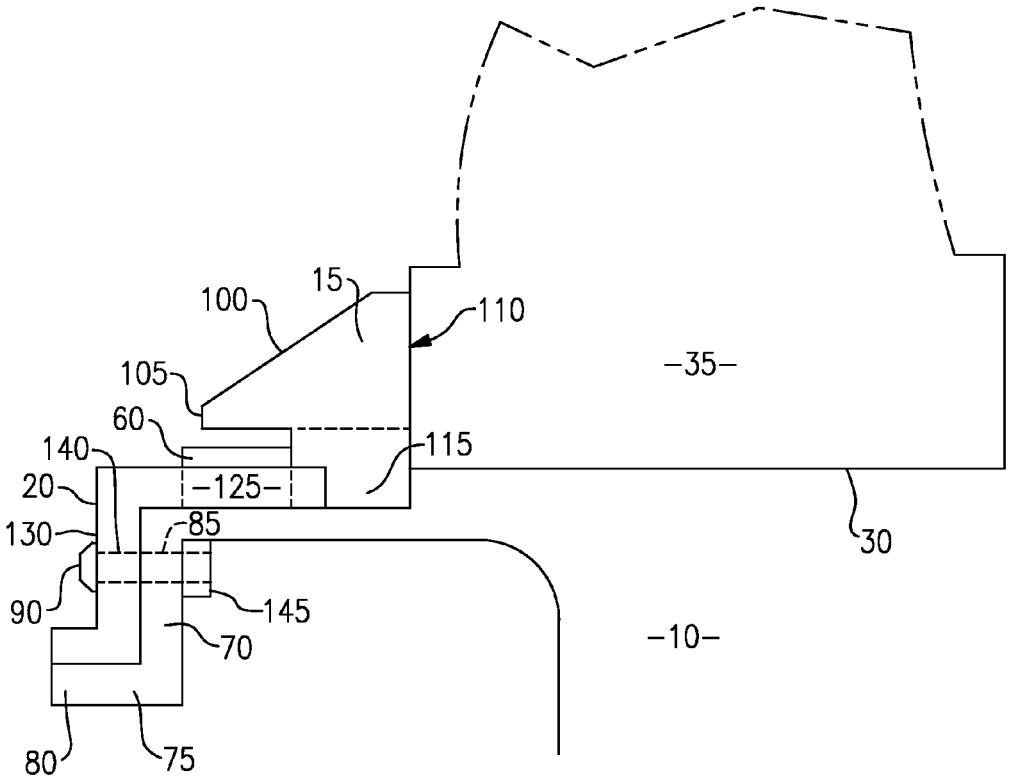
FIG. 3 is a schematic view of the aircraft hub, a lock ring and an anti-rotation ring of FIG. 1. of FIG. 1.

Referring to FIGS. 1-3, a hub 10 for an aircraft engine (not shown) or the like, with a lock ring 15 and an anti-rotation ring 20 is shown. The hub 10 has a plurality of splines 25 for attaching to a shaft (not shown). The hub has a plurality of mounts 30, such as slots, for holding a fan blade root 35. The mounts 30 have a trapezoidal cross section 40 that runs from the front 45 of the hub towards a back 50 of the hub. The trapezoidal cross section securely traps the fan blade root 35 therein. Other shapes of such mounts are contemplated herein.

A circular ring mount 55 is disposed about a front 45 of the hub. The ring mount 55 has a plurality of outer diameter tabs 60 that are separated by gaps 65. The hub also has a plurality of inner diameter tabs 70 extending radially inwardly towards the spline 25. Each inner diameter tab 70 at an end 75 thereof has an axial flange 80 extending outwardly therefrom. The inner diameter tab also has a hole 85 through which a bolt 90 is designed to extend.

Referring to FIGS. 2 and 3, each lock ring 15 has an inner surface 95, an outer surface 100, a front edge 105, a back edge 110, and internal diameter tabs 115 extending around the inner surface 95 of the lock ring.

The anti-rotation ring 20 has a circular body 120, fingers 125 that extend towards the back end 50 of the hub, inner diameter tabs 130 that depend inwardly towards the splines and an axial flange 135 extending radially towards a front of the hub 45. The axial flange 135 sits upon and cooperates with axial flange 80 of the hub. The inner diameter tabs 130 have a hole 140 extending therethrough.

During assembly, the lock ring 15 inner diameter tabs 115 are aligned with and disposed within the gaps 65 of the hub 10 and pushed axially towards the mounts 35 into the circular ring mount 55. Once the inner diameter tabs 115 clear the gaps 65, the lock ring is rotated as shown in FIG. 3 so that the lock ring inner diameter tabs 115 are disposed behind the hub 10 outer diameter tabs 60. Bolts 90 are threaded through holes 140 in the anti-rotation ring 20 and holes 85 in the hub 10 after which nuts 145 (see FIG. 3) are threaded on the bolts and secured thereupon. In this arrangement, the axial flange 135 and the inner diameter tabs 130 of the anti-rotation ring 20 are seated against the inner diameter tabs 70 and axial flanges 80 of the hub 10. The fingers 125 extend through the gaps 65 and prohibit the lock ring from rotating relative to the hub 10.

If there is foreign object damage or bird strike against the blade 155 (see FIG. 3), the strike or damage will cause a moment of inertia to move the blade root forward towards the front end 50 of the hub 10. Because the lock ring 15 is designed to flex torsionally behind the outer diameter tabs 60 of the hub 10, impact of the blade strike will be shared along a circumference of the lock ring 15 such that the anti-rotation key fingers do not shear and the blade lock does not shear and the blade root is retained within the hub 10.

By allowing movement, such as deflection, in the lock ring 15 about a circumference thereof, split rings of the prior art (not shown) may be eliminated and the weight of the lock ring will be minimized to allow a more efficient arrangement.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A lock for constraining blades in a hub, said lock comprising:

a flexible first ring for constraining the blades from moving axially in the hub, wherein the flexible first ring includes a radially inner surface and a radially outer surface; and fingers attached to said hub and preventing said flexible first ring from rotating, wherein said flexible first ring is unconstrained about the radially outer surface such that the radially outer surface flexes axially about at least a partial circumference responsive to axially forward movement by said blades.

2. The lock of claim 1 further comprising; a second ring upon which said fingers are mounted, said second ring being attached to the hub.

3. The lock of claim 2 further comprising; a mounting bracket disposed upon said hub for attaching to said second ring.

4. The lock of claim 1 further comprising; a first plurality of tabs disposed on said hub for preventing said flexible first ring from traveling more than a given distance axially.

5. The lock of claim 4 wherein said fingers extend through gaps between said first plurality of tabs to prevent said flexible first ring from rotating.

6. The lock of claim 5 wherein said flexible first ring has a second plurality of tabs extending therefrom.

7. The lock of claim 6 wherein said said first plurality of tabs and said second plurality of tabs are offset from each other for receiving the flexible first ring onto said hub.

8. The lock of claim 7 wherein said first plurality of tabs on said hub are aligned with said second plurality of tabs of the flexible first ring in an assembled position.

9. A method for mounting a blade on a hub comprising:

inserting a blade root into a slot in said hub;

placing a flexible first ring against said blade root;

constraining axial movement of a radially inner surface of the flexible first ring and not constraining axial movement of a radially outer surface of the flexible first ring; and placing a finger inside said flexible first ring for preventing rotation of said flexible first ring and wherein said radially outer surface of the flexible first ring flexes axially responsive to axial movement of said blade root.

10. The method of claim 9 wherein the placing a flexible first ring against the blade root comprises the steps of pushing the flexible first ring through a plurality of gaps on the hub, and rotating the flexible first ring so that a portion of said flexible first ring is constrained against axial forward movement behind tabs on said hub.

11. The method of claim 10 including the step of attaching said finger to said hub.

12. The method of claim 10 wherein a portion of said flexible first ring is disposed between portions of said hub.

* * * * *